US009073737B2

(12) United States Patent
Elder

(10) Patent No.: US 9,073,737 B2
(45) Date of Patent: Jul. 7, 2015

(54) JACK STAND FOR WIRE SPOOLS

(71) Applicant: Doyle Elder, Arapaho, OK (US)

(72) Inventor: Doyle Elder, Arapaho, OK (US)

( * ) Notice: Subject to any disclaimer, the term of this patent is extended or adjusted under 35 U.S.C. 154(b) by 200 days.

(21) Appl. No.: 13/657,808

(22) Filed: Oct. 22, 2012

(65) Prior Publication Data

US 2014/0110646 A1 Apr. 24, 2014

(51) Int. Cl.
*B66F 3/08* (2006.01)

(52) U.S. Cl.
CPC ..... *B66F 3/08* (2013.01)

(58) Field of Classification Search
CPC ..... B66F 3/08
USPC ..... 254/2 B, 134, 100, 103, 418–425; 269/289 MR, 17; 29/243.55
See application file for complete search history.

(56) References Cited

U.S. PATENT DOCUMENTS

| | | | | |
|---|---|---|---|---|
| 1,825,218 A | | 2/1930 | Van Hook | |
| 3,298,667 A | | 2/1965 | Grantham et al. | |
| 3,844,535 A | * | 10/1974 | Dorough, Jr. | 254/103 |
| 3,941,352 A | | 3/1976 | Nehrig et al. | |
| 4,030,704 A | | 6/1977 | Beierle et al. | |
| 4,050,671 A | * | 9/1977 | Coleman | 254/7 R |
| 4,447,012 A | | 5/1984 | Woodruff | |
| 4,516,905 A | * | 5/1985 | Cavin et al. | 414/620 |
| 4,679,743 A | | 7/1987 | Dallmaier | |
| 4,779,856 A | * | 10/1988 | Beeler | 269/45 |
| 6,050,548 A | * | 4/2000 | Leger | 254/326 |
| 6,874,764 B2 | | 4/2005 | Drake, III | |
| 7,823,861 B2 | | 11/2010 | Krug | |

* cited by examiner

*Primary Examiner* — Lee D Wilson
*Assistant Examiner* — Nirvana Deonauth
(74) *Attorney, Agent, or Firm* — James F. Harvey, III

(57) ABSTRACT

An apparatus and associated method for lifting a workpiece. An upright frame operably supports a lead screw for selective rotation. A carrier threadingly engages the lead screw so that rotation of the lead screw in one rotational direction linearly advances the carrier in a lifting direction and rotation of the lead screw in the opposite rotational direction linearly advances the carrier in a lowering direction. A mechanical power inlet is adapted for receiving an input torque from a user. A mechanical power transmission assembly has a first gear fixed in rotation with the mechanical power inlet and a different second gear fixed in rotation with the lead screw, the first and second gears sized so that the input torque imparted on the first gear is less than an output torque imparted by the second gear to the lead screw.

17 Claims, 11 Drawing Sheets

JACK STAND FOR WIRE SPOOLS

CROSS-REFERENCES TO RELATED APPLICATIONS

This application claims the benefit of U.S. Provisional Patent Application Ser. No. 61/550,400, filed on Oct. 22, 2011, the contents of which are hereby incorporated by reference in their entirety.

BACKGROUND OF THE INVENTION

The present invention generally relates to methods and devices for material handling, and more particularly without limitation to lifting a spool of flexible elongate material, so that the spool can be rotated around a horizontal axis to wind or unwind the flexible elongate material contained therein.

SUMMARY OF THE INVENTION

Some embodiments of the present invention are directed to an apparatus for lifting and supporting a workpiece. Such an apparatus includes an upright frame and a lead screw that is supported for selective rotation by the frame. A carrier threadingly engages the lead screw so that rotation of the lead screw in a first rotational direction linearly moves the carrier in a lifting direction and rotation of the lead screw in a second rotational direction linearly moves the carrier in a lowering direction. A mechanical power inlet feature is adapted for receiving an input torque from a user. A mechanical power transmission has a first gear fixed in rotation with the mechanical power inlet and a different second gear fixed in rotation with the lead screw, the first and second gears sized so that the input torque imparted on the first gear is less than an output torque imparted by the second gear to the lead screw.

Other embodiments of the present invention are concerned with a jack stand having a frame with a longitudinal base beam defining a proximal end and an opposing distal end. The frame has an upright support beam connected to the base beam between the proximal end and a base beam midpoint and extending substantially orthogonal from the base beam. A lead screw is supported by the frame for selective rotation. A carrier threadingly engages the lead screw so that rotation of the lead screw in a first rotational direction linearly advances the carrier in a lifting direction and rotation of the lead screw in a second rotational direction linearly advances the carrier in a lowering direction.

Still other embodiments of the present invention contemplate a method including obtaining an apparatus that includes an upright frame and a lead screw supported by the frame for selective rotation. A carrier threadingly engages the lead screw so that rotation of the lead screw in one rotational direction linearly advances the carrier in a lifting direction and rotation of the lead screw in the opposite rotational direction linearly advances the carrier in a lowering direction. A mechanical power inlet is adapted for receiving an input torque from a user. A mechanical power transmission has a first gear fixed in rotation with the mechanical power inlet and a different second gear fixed in rotation with the lead screw, the first and second gears sized so that the input torque imparted on the first gear is less than an output torque imparted by the second gear to the lead screw. The method further includes rotating the mechanical power inlet feature to align the carrier with the workpiece; and after aligning the support member with the workpiece, rotating the mechanical power inlet to linearly advance the carrier against the workpiece and thereby lift the workpiece.

These and other features, aspects, and advantages of the present invention will become better understood with reference to the following drawings, description, and claims.

DETAILED DESCRIPTION OF THE INVENTION

The following detailed description is of the best currently contemplated modes of carrying out the invention. The floor jacking concepts herein are not necessarily limited to use or application with any specific workpiece and associated methods, although the illustrative embodiments are well suited for lifting a spool of wire as the workpiece. Thus, although the instrumentalities described herein are shown and described with respect to exemplary embodiments for the convenience of explanation, the principles herein may be applied equally in other types of workpieces and associated methods of material handling. The description is thus not to be taken in a limiting sense, but is made merely for the purpose of illustrating the general principles of the invention, since the scope of the invention is best defined by the appended claims.

Figure 1:
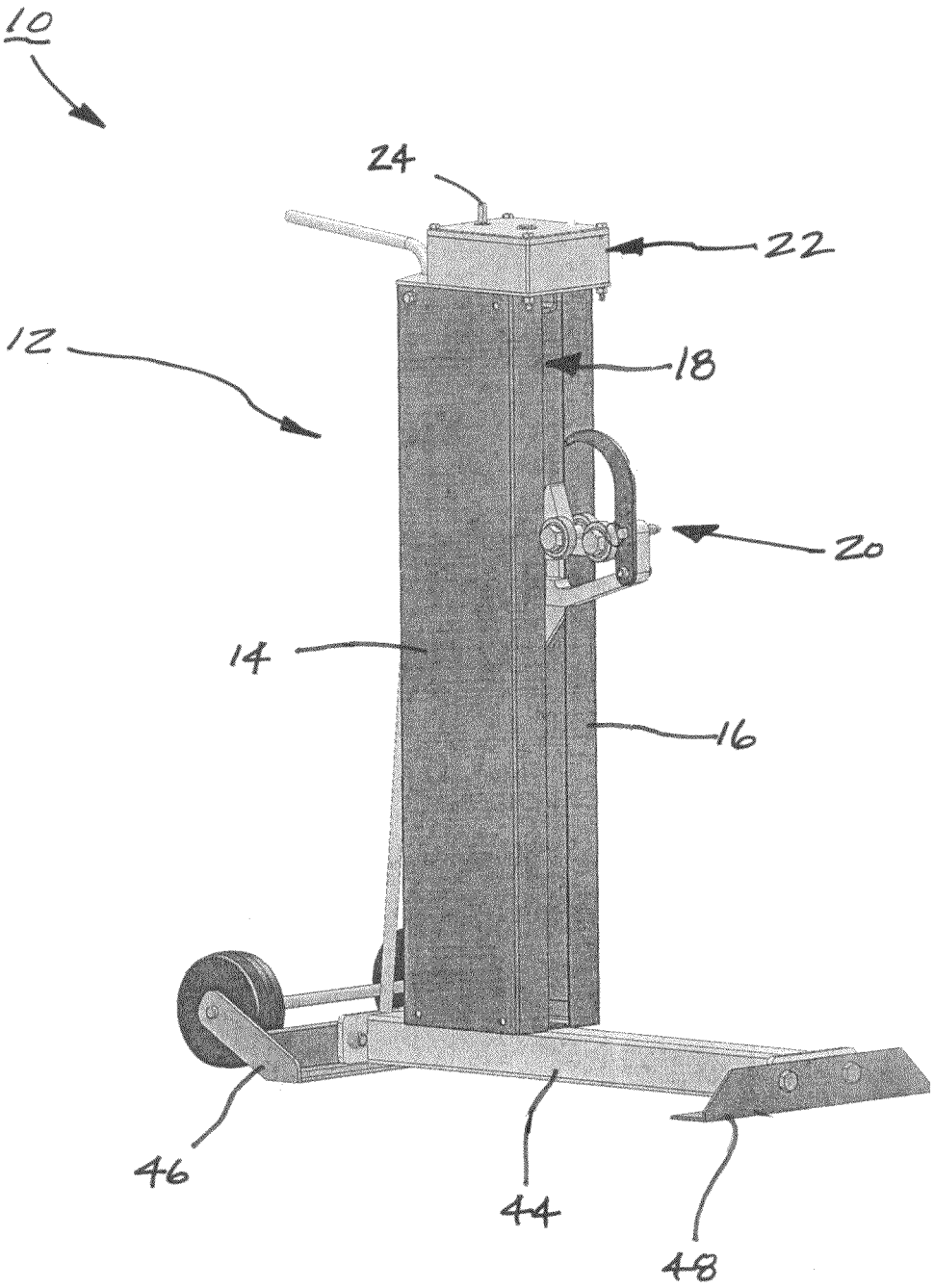
FIG. 1 is an isometric depiction of an apparatus that is constructed in accordance with illustrative embodiments of the present invention.

Referring now to FIG. 1, isometric depiction of a jack stand 10 is shown constructed in accordance with illustrative embodiments of the present invention. The jack stand 10 may generally have an upright frame 12 which may include removable covers 14, 16 that operably safeguard a user from moving parts enclosed within the covers 14, 16. An opening 18 may be provided between the covers 14, 16 to permit selective movement of a carrier 20 to raise a workpiece off a generally horizontal support surface such as a floor. Note that although in these illustrative embodiments the carrier 20 movement is vertical in relation to the horizontal support surface, the contemplated embodiments are not so limited in that alternative embodiments can selectively move a carrier or like lifting mechanism in a direction other than vertical.

The jack stand 10 may also include a mechanical power transmission 22 that converts a force supplied by the user to a force on the carrier 20 that is sufficient to move the desired load either upwardly or downwardly with respect to the support surface. The force supplied by the user may be a torque applied to a protuberant mechanical power inlet 24.

The jack stand 10 of the present embodiments may be well suited, in these teaching examples, for lifting a spool around which a workpiece is spooled, such as wire, tubing, or some other flexible elongate material. It may be advantageous to buy such spooled workpieces in bulk quantity to reduce material cost and improve quality by reducing the number of spliced joints. However, bulk quantities require larger and heavier spools. It is not unusual for a user to have a need to handle six foot diameter spools weighing three thousand pounds or more.

Figure 2:
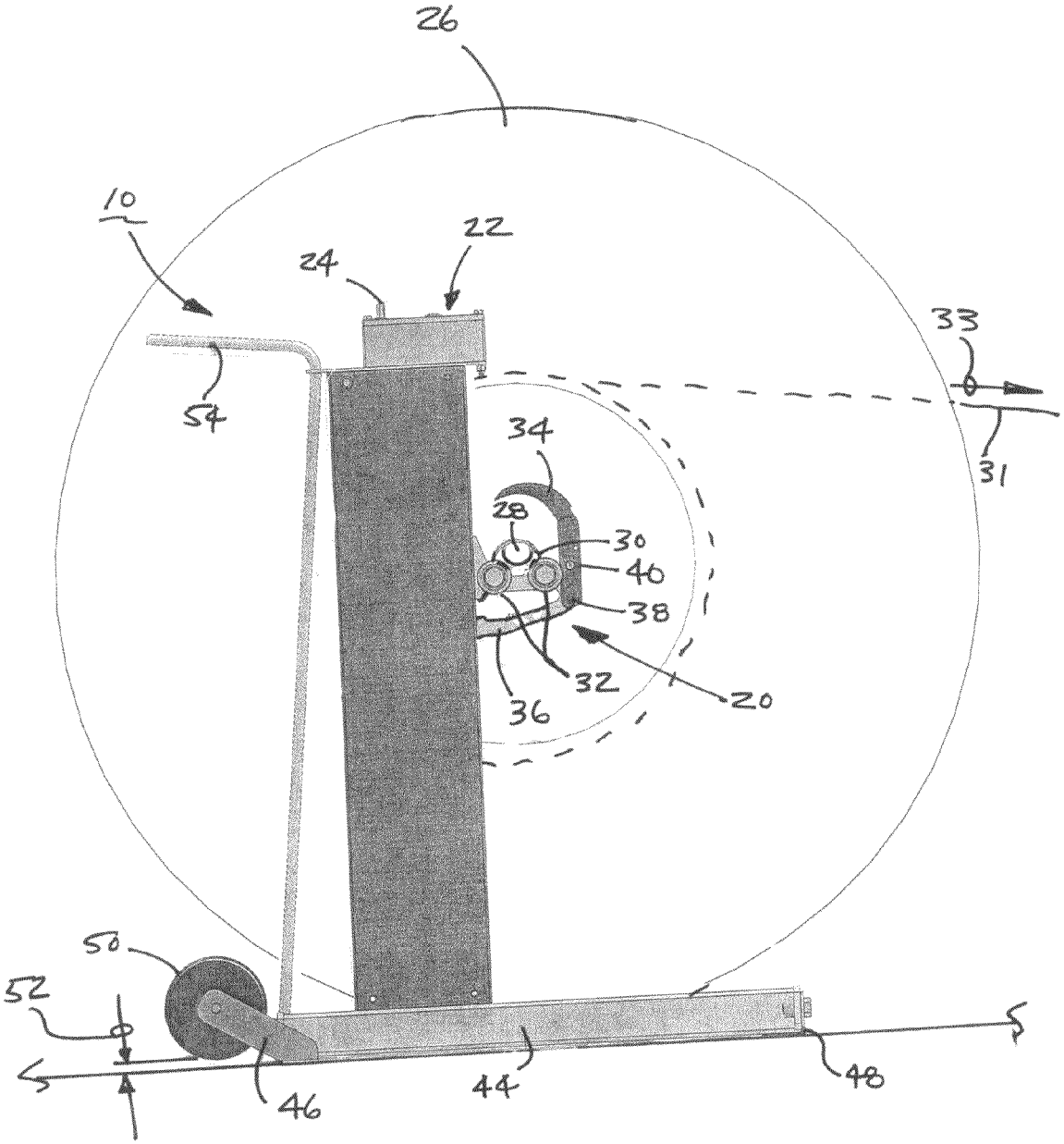
FIG. 2 is a side elevational depiction of the apparatus of FIG. 1.

Referring now to FIG. 2, one of a pair of jack stands 10 is depicted, which cooperatively lift such a large and heavy spool 26 upon an axle 28 placed through the spool's 26 center bore 30. It will be understood that the other jack stand 10 is placed in like manner on the opposing side of the spool 26, and as such it is hidden in the depiction of FIG. 2. The jack stands 10 may be capable of lifting the spool 26 off the ground (or other support surface) so that the spool 26 may be rotationally free to rotate as the workpiece 31 is pulled off the spool 26 in a direction denoted by reference arrow 33. In order to handle a variety of different size spools, the carrier 20 may in some embodiments be selectively positionable from about six inches above the support surface to a little over thirty-six inches above the support surface. Note that in these illustrative embodiments the carrier 20 may include support rollers 32 to facilitate rotation of the axle 28 as the workpiece 31 is removed from the spool 26.

A sufficient inlet torque for lifting the spool 26 can be imparted to the mechanical power inlet 24 by use of a standard power tools found around a typical work site for imparting torque to items, such as power drills (both corded and cordless), hammer drills, and ordinary cordless screwdriver hand tool (tools not depicted). Torque may also be applied to the mechanical power inlet 24 by means of unpowered hand tools, such as a lug wrench, a detachable handle, or a socketed wheel. To accommodate the use of such torqueing tools, the mechanical power inlet 24 may be preferably configured with a working end that defines a surface engageable with a standard size tool bit or socket in a close mating relationship, such as a standard size bolt head configuration.

FIG. 2 shows the carrier 20 which may further include a retainer 34 depicted in a closed position to operably retain the axle 28 supported on the carrier 20. Without the retainer 34, the unwinding force on the workpiece in direction 33 and/or some resistance to spool 26 rotation might disadvantageously pull the axle 28 off the carrier 20. The retainer 34 may be selectively moveable to an open position. In these illustrative embodiments, for example, the retainer 34 may be connected to a structural base 36 at a rotational joint 38. A removable pin 40 may be inserted into aligned holes in the retainer 34 and the base 36 to lock the retainer 34 in the closed position depicted in FIG. 2. Removing the pin 40 may permit rotating the retainer 34 to an open position, making it possible to move the carrier 20 into place for lifting the axle 28. For example, by the force of gravity the hooked end of the retainer 34 in the open position may point vertically downward, permitting an operable movement of the jack stand 10, and hence the carrier 20, in direction 42 to slide unencumbered under the axle 28 into an aligned position, where raising the carrier 20 may place the support rollers 32 in contact with the axle 28.

Figure 3:
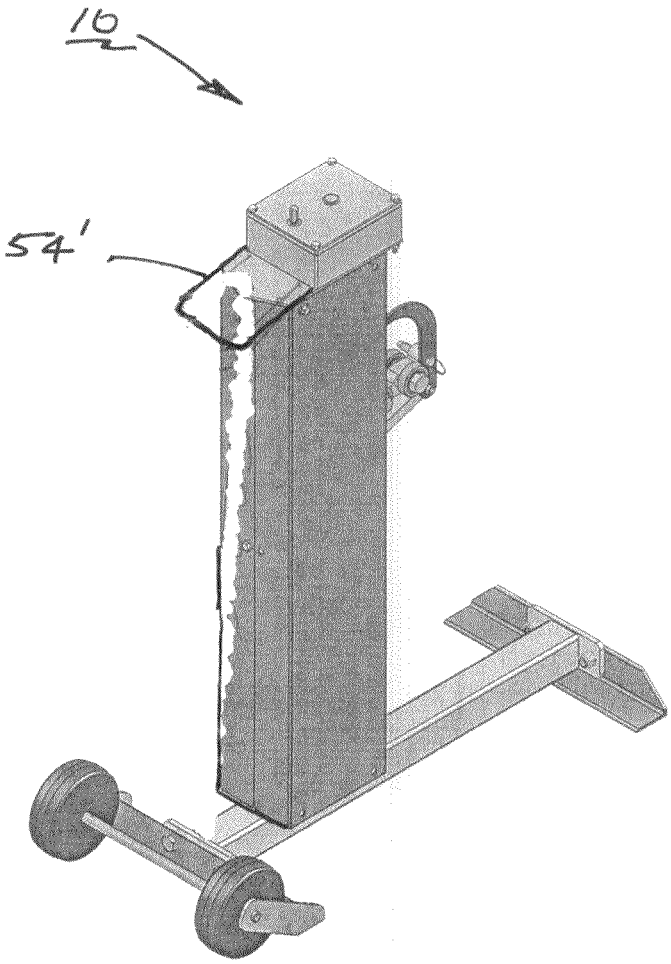
FIG. 3 is a rear isometric depiction of an apparatus that is constructed in accordance with alternative embodiments of the present invention.

FIGS. 1 and 2 further depict an upright frame 12 which includes a longitudinal base beam 44 with spreader plates 46, 48 individually attached to proximal and distal ends of the longitudinal base beam 44, respectively. The spreader plates 46, 48 may operably contact the support surface upon which the jack stand 10 is lifting, typically upon the ground surface which can be notoriously non-level. The spreader plates 46, 48 may effectively distribute the weight of the lifted spool 26 to a two-point contact with the ground in order to minimize the effects of uneven ground between the spreader plates 46, 48. The spreader plate 46 also supports a pair of transport rollers 50 that are operably offset above the ground by a distance 52 to prevent them from bearing any weight of the lifted spool 26. When the lifting is complete, the jack stand 10 may be pivoted rear-ward to bring the transport rollers 52 into contact with the support surface, so that upon the transport rollers 52 the jack stand 10 can be transported to the next desired location. A handle 54 may be provided for the user to pivot the jack stand 10 upon the transport rollers 52, and then for the user to guide the jack stand 10 as it is rolled upon the transport rollers 52. FIG. 3 depicts an alternative U-shaped handle 54'.

Figure 4:
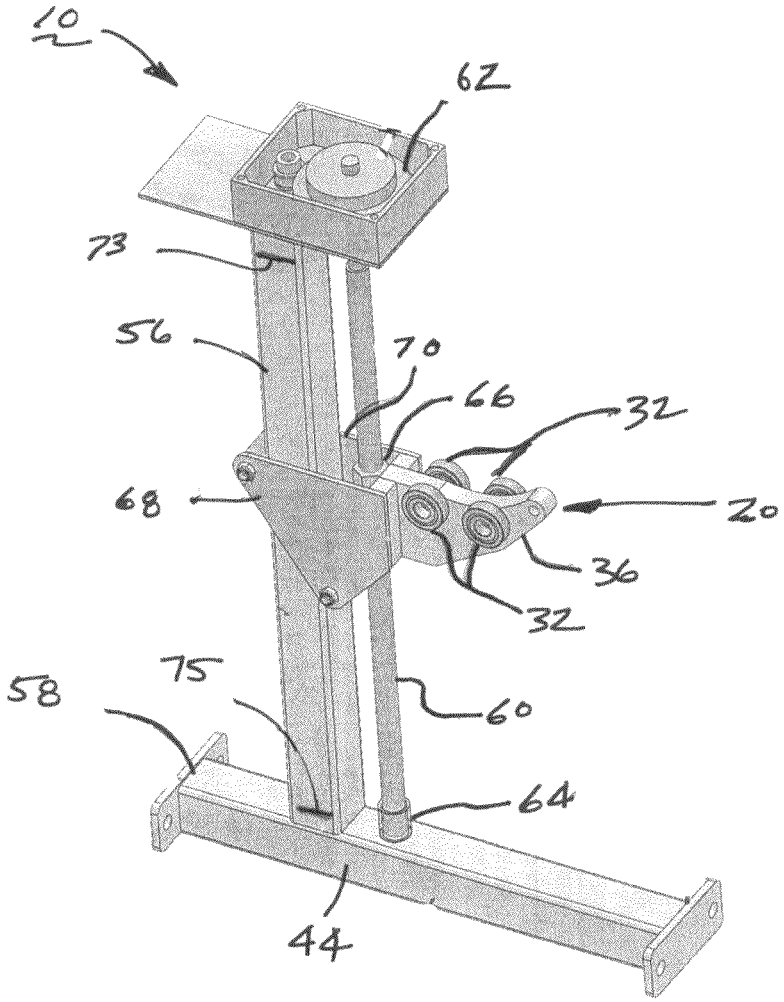
FIG. 4 is a view similar to FIG. 1 but with the covers and supports removed to depict the underlying structural framework and working components.

FIG. 4 is an isometric depiction of the jack stand 10 similar to FIG. 1 but with portions of the upright frame 12 removed for clarity to reveal working components inside the enclosure of the covers 14, 16. The longitudinal base beam 44 supports an upright support beam 56. In these illustrative embodiments, both beams 44, 56 may be constructed of square tubing, and the beams 44, 56 may be joined together by any substantial means, such as by welding or bolting. The upright beam 56 may extend substantially orthogonally from the base beam 44 at a position between a proximal end 58 of the base beam 44 and a midpoint of the base beam 44, in order that the support rollers 32 are distributed substantially above the midpoint of the base beam 44.

Figure 8:
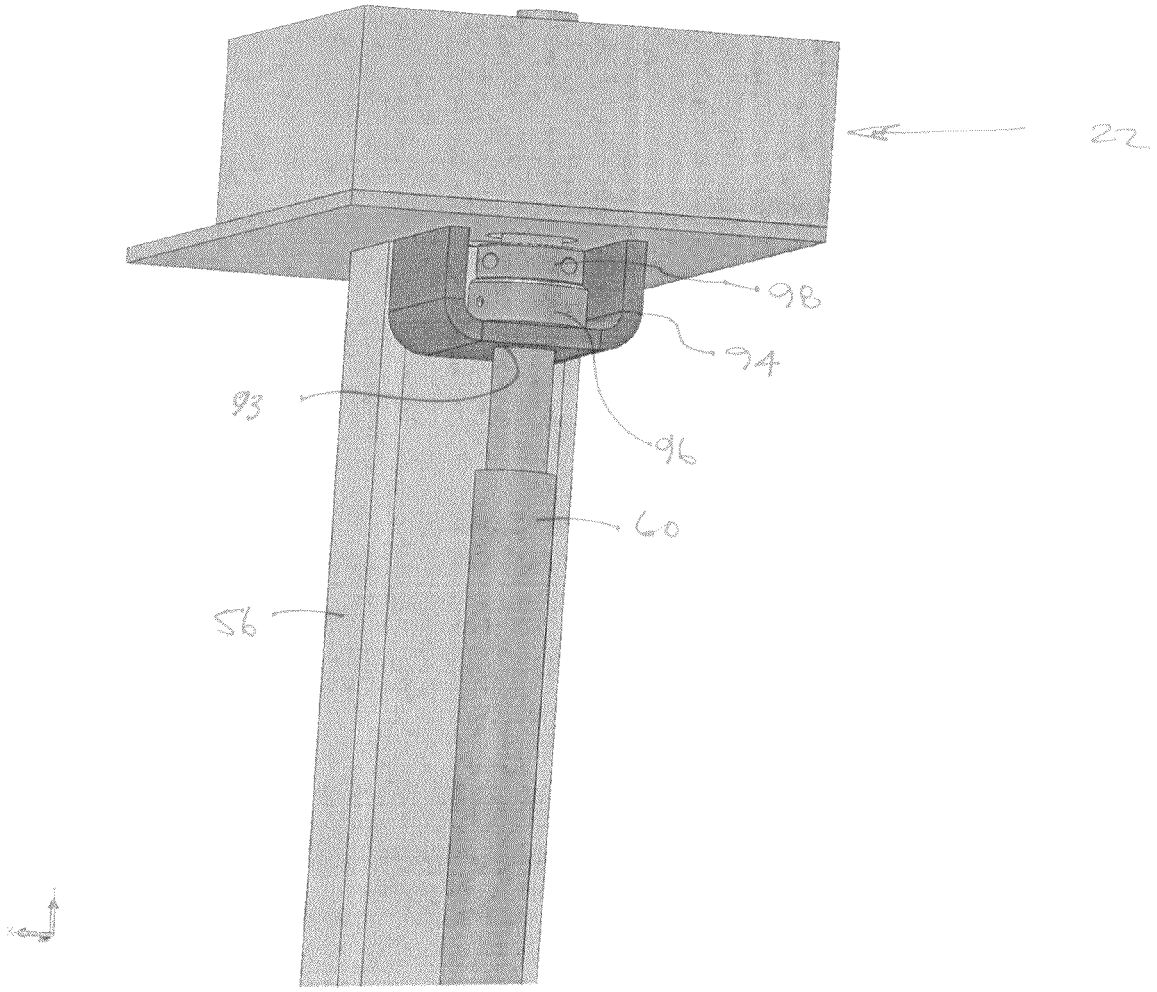
FIG. 8 is an isometric depiction of the bearing supporting the top end of the lead screw in rotation.

A threaded lead screw 60 may be supported for rotation at a lower end upon the base beam 44 and at an upper end by a driven gear 62 in the mechanical power transmission 22. The lower end of the lead screw 60 may be preferably supported for rotation by a load-bearing member 64, such as a bushing or a thrust bearing and the like. As depicted in FIG. 8, the upper end of the lead screw 60 may be likewise preferably supported in rotation by a load bearing member 64 such as a bushing or a thrust bearing in like manner.

Figure 6:
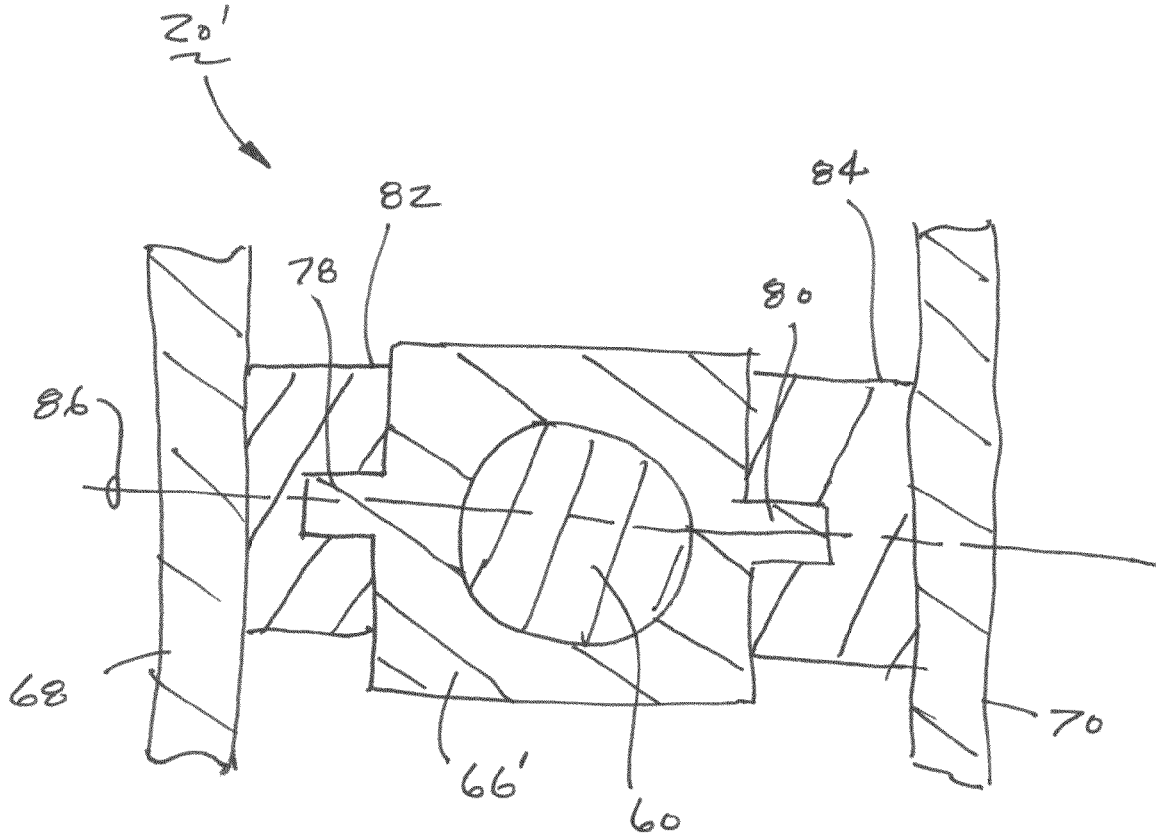
FIG. 6 is a cross sectional depiction of a one-axis dynamic attachment of the follower to the lead screw.

Still referring to FIG. 6, the carrier 20 may have a threaded follower 66 attached to the base 36. A rotation of the lead screw 60 in a first direction may cause a threaded advancement of the follower 66 in a first linear direction. The base 36, being affixed to the follower 66, may be likewise linearly advanced by the linear advancement of the follower 66. In the same manner, a rotation of the lead screw 60 in the opposite direction (i.e. a second direction) may cause a threaded advancement of the follower 66, and in turn a linear advancement of the carrier 20, in the opposite linear direction. In this manner, rotation of the lead screw 60 in one direction may raise the carrier 20 away from the support surface, and rotation of the lead screw 60 in the opposite direction may lower the carrier 20 towards the support surface.

Figure 5:
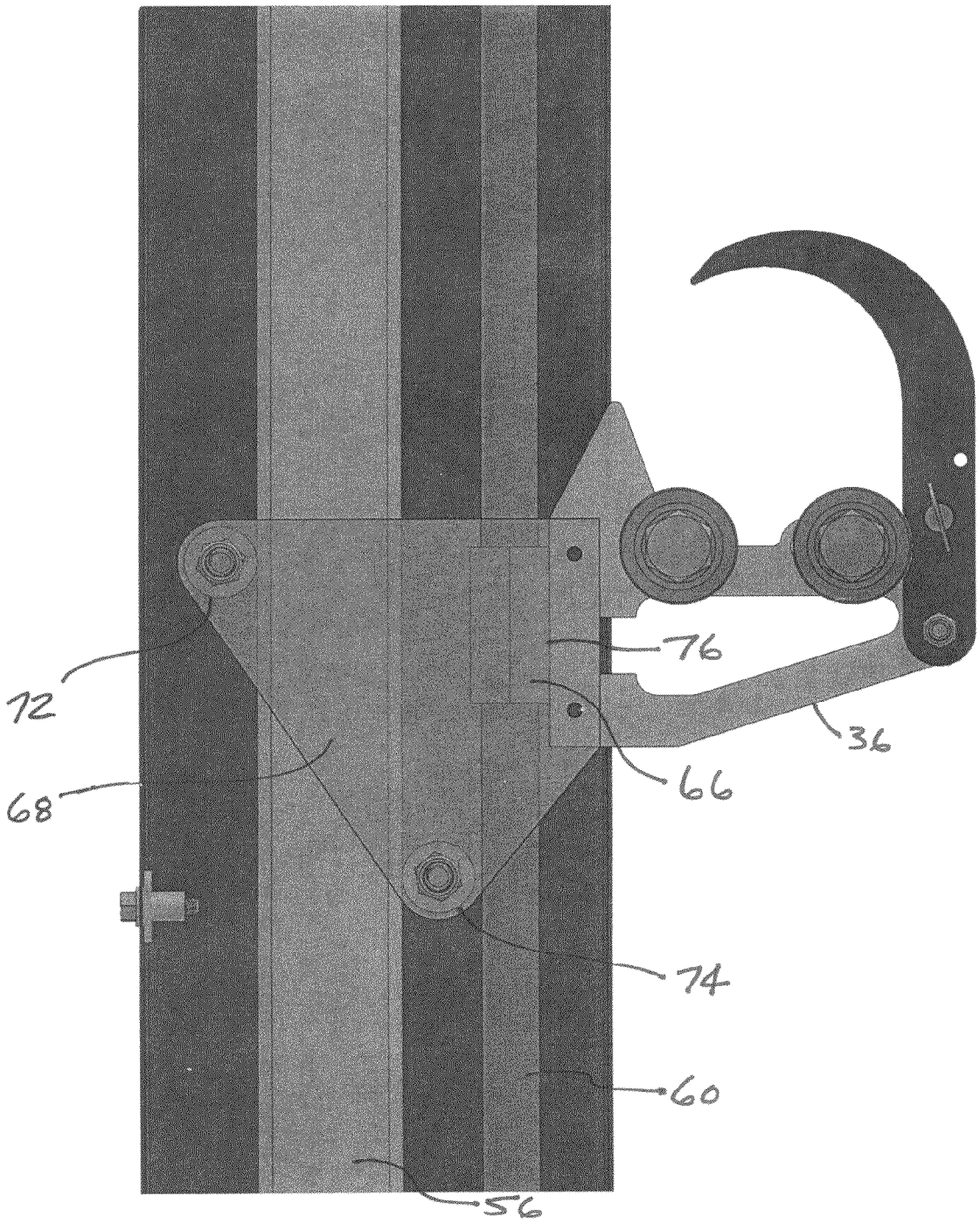
FIG. 5 is a side elevational depiction of an enlarged portion of FIG. 4 more particularly depicting the carrier.

Opposing web plates 68, 70 may be attached individually at one end to the base 36 and extend therefrom to distribute the weight lifted by the carrier 20 to the upright beam 56. FIG. 5 is an enlarged and partially cutaway elevational depiction of the carrier 20 showing the web plates 68, 70 (only web plate 68 visible in FIG. 5) supporting a pair of guide rollers 72, 74 against opposing sides of the upright beam 56. In these illustrative embodiments, the follower 66 may be rigidly affixed to the base 36, such as by a weld 76. Even so, the weight lifted by the carrier 20 may be transferred through the web plates 68, 70 to the guide rollers 72, 74 that pressingly engage against the upright beam 56 to unload the follower 66, so that follower 66 may be threadingly advanced by the selective rotation of the lead screw 60. That is, the weight lifted by the carrier 20 may be supported by the upright beam 56 so that the follower 66 is free to threadingly advance along the lead screw 60 without undue pressure of the threadingly engaged components against each other. Protuberant positive stop bumpers 73, 75 may abuttingly engage the web plate 68 to limit the carrier 20 travel at the upper and lower extents of travel, respectively.

In an alternative embodiment, the follower 66 may be dynamically attached in the carrier instead of rigidly attached as described above. A dynamic, or floating, attachment permits the axial alignment of the follower 66 and lead screw 60 to vary as the follower 66 advances longitudinally along the lead screw 60. This dynamic adjustment can aid in compensating for positional variance of the lead screw 60, and in compensating for part-to-part variation in manufacturing processes, resulting in reduced frictional resistance between the threadingly engaged components.

Figure 7:
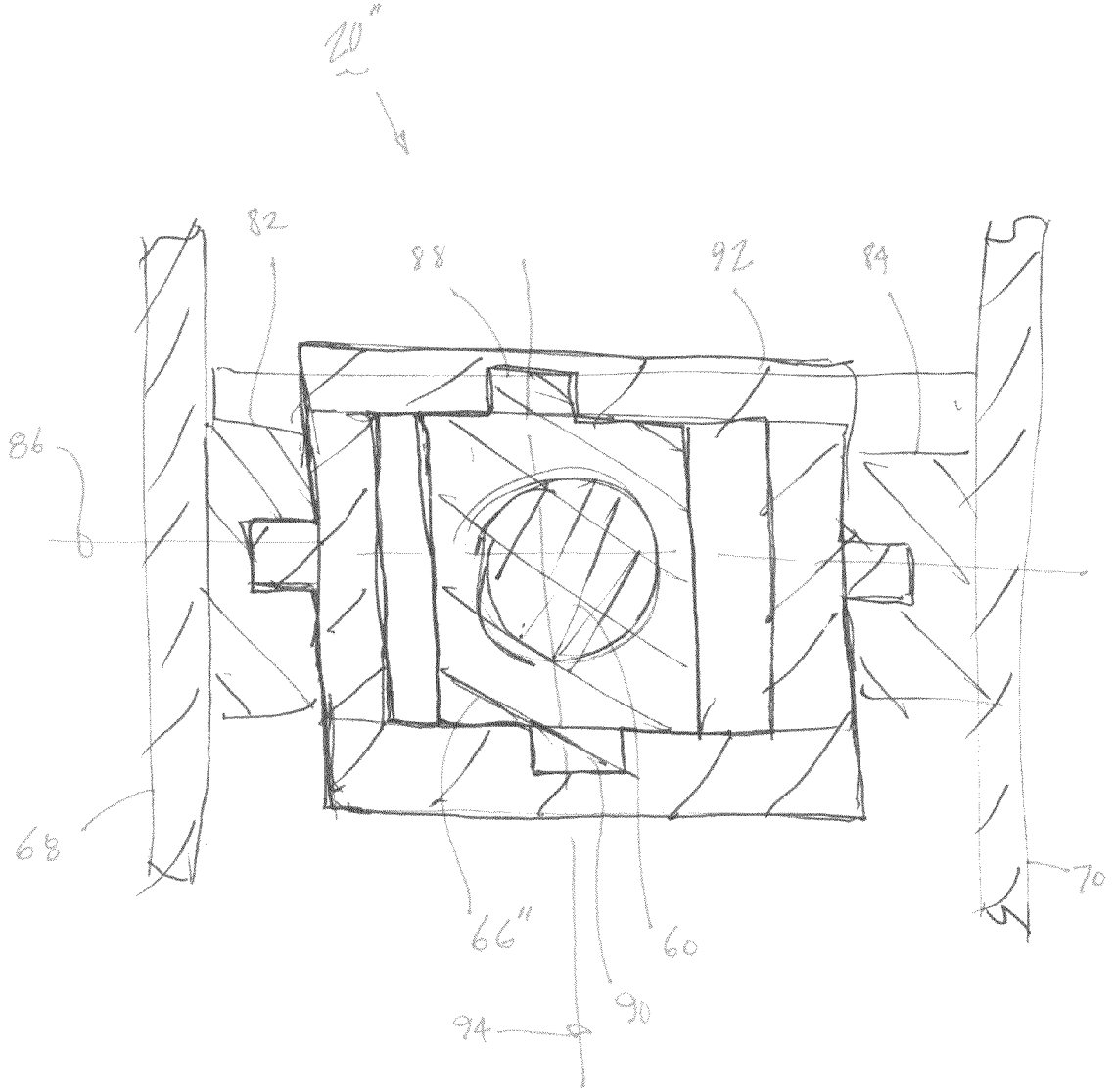
FIG. 7 is a cross sectional depiction of a two-axis dynamic attachment of the follower to the lead screw.

Referring now to FIG. 6, a cross-sectional view of a portion of a carrier 20' is shown, constructed in accordance with alternative embodiments of the present invention. Here, a follower 66' may be dynamically connected by pins 78, 80 to corresponding blocks 82, 84 that are, in turn, affixed to the web plates 68, 70. The pins 78, 80 and corresponding bores in the blocks 82, 84 may be sized to permit operable rotation of the follower 66' around an axis 86 that is substantially orthogonal to the longitudinal base beam 44 (FIG. 1).

Where FIG. 6 depicts embodiments dynamically mounting the follower 66' for longitudinal compensation around one axis of rotation, FIG. 7 depicts alternative embodiments dynamically mounting a follower 66" for longitudinal compensation around two different axes of rotation. Here, the follower 66" may be dynamically connected by pins 88, 90 to a frame 92. The pins 88, 90 and corresponding bores in the frame 92 may be sized to permit operable rotation of the follower 66" around an axis 94 that is substantially parallel to the longitudinal base beam 44 (FIG. 1). The frame 92 may be pinned to the blocks 82, 84 as described above to permit operable rotation of the follower 66" around the axis 86 that is substantially orthogonal to the longitudinal base beam 44.

FIG. 8 depicts the upper end of the lead screw 60, which may have a non-threaded end that passes through a hole 93 in a bearing support 94 extending from the upright support beam 56. A thrust bearing 96 may be secured to the end of the lead screw 60 by a locking collar 98. The distal end of the lead screw 60 may extend upwardly into the mechanical power transmission 22.

Figure 9:
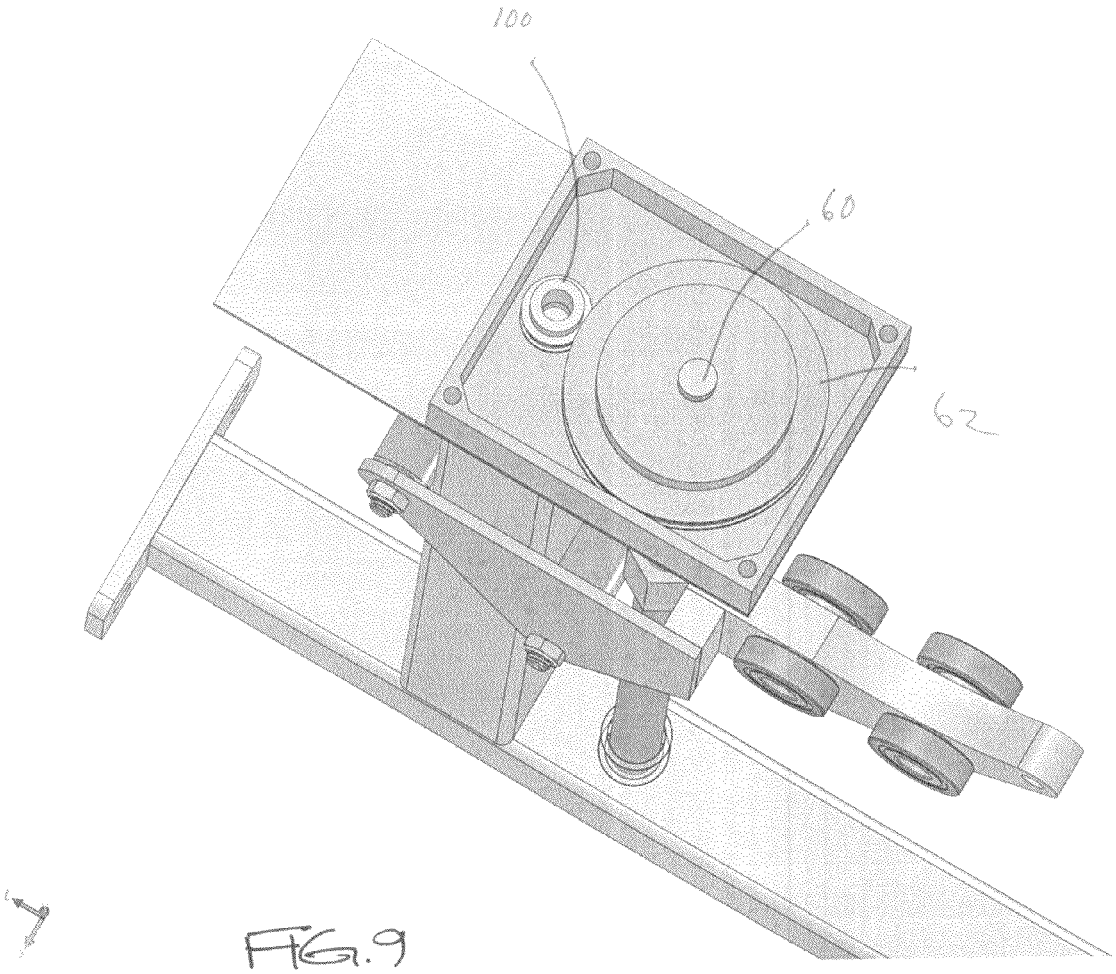
FIG. 9 is an isometric depiction of the mechanical power transmission with the cover removed to reveal the working components.

FIG. 9 is a top isometric depiction with the cover removed from the mechanical power transmission 22 to reveal the gearing components contained therein. A drive gear 100 may be connected to the protuberant mechanical power inlet 24 (FIG. 1) to directly receive the torque supplied by the user. The drive gear 100 may be meshingly engaged with the driven gear 62 affixed in rotation with the lead screw 60. The drive gear 100 may be smaller than the driven gear 62 in order to slow the rotational speed while stepping up the torque that is ultimately imparted to the lead screw 60. Preferably, the number of gear turns of the drive gear 100 to the number of gear turns of the driven gear 62, the gear turn ratio, may preferably be at least one and a half to one, and more preferably at least three to one. That mechanical power transmission arrangement may permit a torque transfer from an ordinary cordless drill working on the mechanical power inlet 24 to impart a sufficient torque on the lead screw 60 by the driven gear 62, which may be capable of lifting a spool weighing about three thousand pounds or more.

Figure 10:
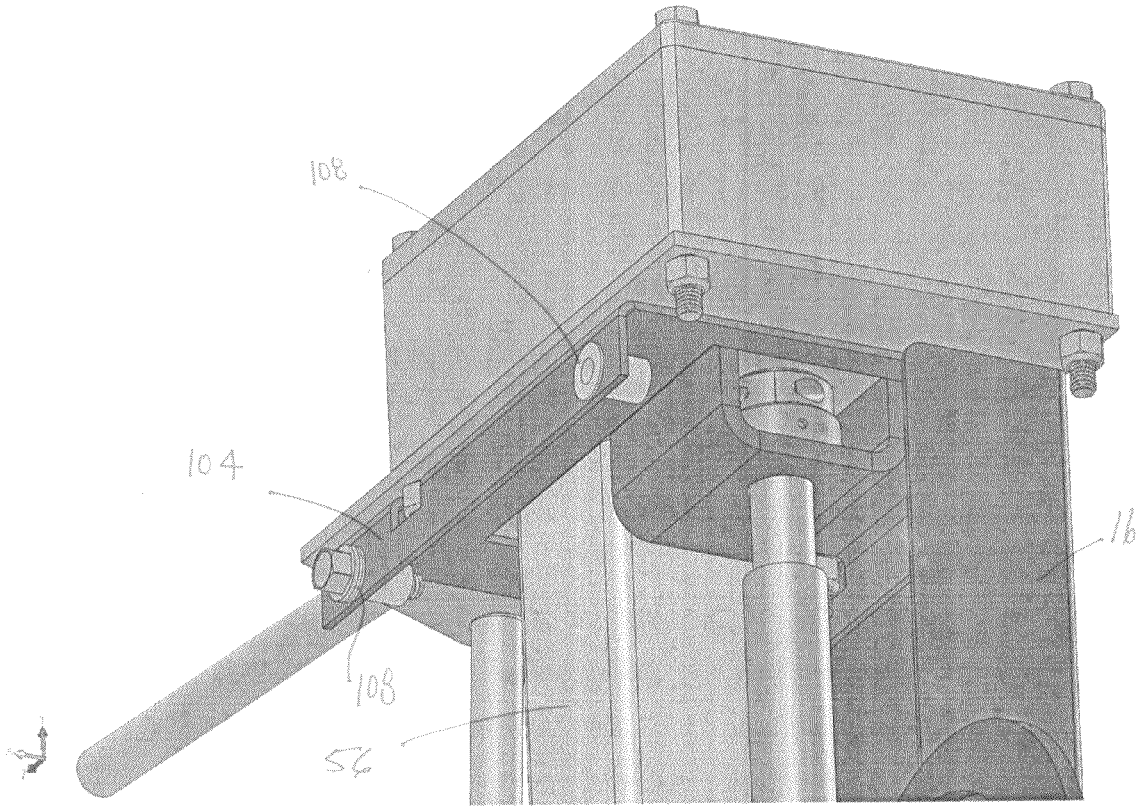
FIG. 10 is an isometric depiction of a collar attached to the top and bottom of the upright frame for attaching the removable covers, according to an embodiment of the invention.
Figure 11:
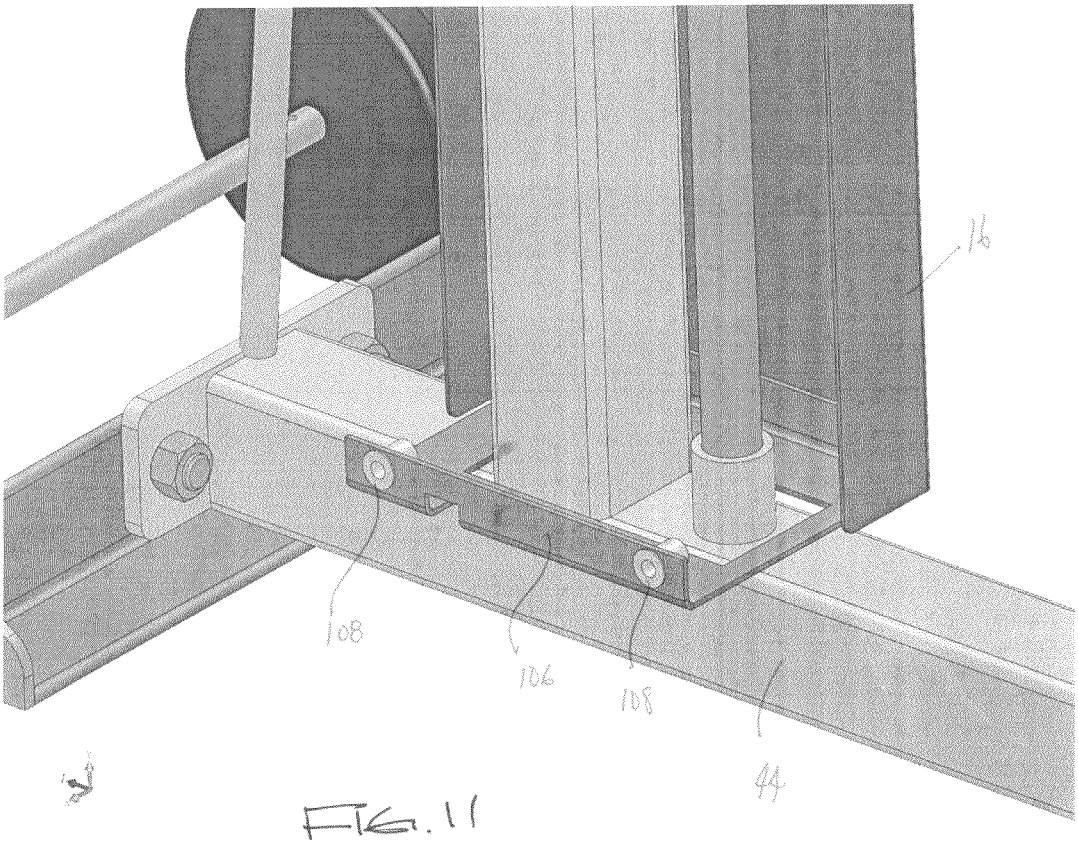
FIG. 11 is an isometric depiction of another embodiment showing a collar attached to the top and bottom of the upright frame for attaching the removable covers.

Finally, FIGS. 10 and 11 depict the upright frame 12 (FIG. 1) and further include a collar 104 attached to the top of the upright beam 56 and another collar 106 attached to the base beam 44. The collars 104, 106 may support fastening features 108, such as threaded inserts, sized and positioned to receive removable fasteners for attaching the covers 14, 16.

It is to be understood that even though numerous characteristics and advantages of various embodiments of the present invention have been set forth in the foregoing description, together with the details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. For example, interfacing support components other than the carrier disclosed herein are contemplated while still maintaining substantially the same functionality without departing from the scope and spirit of the claimed invention. Further, although the illustrative embodiments described herein are directed to handling workpiece spools, such as wire spools and related technology, it will be appreciated by those skilled in the art that the claimed invention can be applied to other workpieces requiring a handling assist device as well without departing from the spirit and scope of the present invention.

I claim:

1. An apparatus for lifting a workpiece, the apparatus comprising:

an upright frame;

a lead screw supported by the frame for selective rotation;

a carrier threadingly engaging the lead screw, the carrier comprising a web member;

a first guide roller attached to the web member for rolling engagement against one side of the support rail;

a second guide roller attached to the web member for operable rolling engagement against an opposing side of the support rail;

a threaded follower attached to the web member and threadingly engaging the lead screw; and a support arm extending from the web and sized to operably and matingly engage the workpiece for lifting the workpiece;

wherein rotation of the lead screw in one rotational direction linearly advances the carrier in a lifting direction and rotation of the lead screw in the opposite rotational direction linearly advances the carrier in a lowering direction;

a mechanical power inlet adapted for receiving an input torque from a user; and a mechanical power transmission having a first gear fixed in rotation with the mechanical power inlet and a different second gear fixed in rotation with the lead screw, the first and second gears sized so that the input torque imparted on the first gear is less than an output torque imparted by the second gear to the lead screw.

2. The apparatus of claim 1, wherein the carrier comprises a support roller defining a support surface capable of lifting the workpiece.

3. The apparatus of claim 1, wherein the carrier comprises a retainer member that is selectively moveable between an open position permitting operable linear advancement of the carrier under the workpiece and a closed position operably retaining the workpiece upon the carrier.

4. The apparatus of claim 1, wherein the frame comprises a longitudinal base beam defining a proximal end and an opposing distal end, and an upright support beam connected to the base beam between the proximal end and a base beam midpoint and extending substantially orthogonal from the base beam.

5. The apparatus of claim 1, wherein the threaded follower is dynamically attached to the web to permit displacement of the threaded follower in relation to a longitudinal axis of the lead screw.

6. The apparatus of claim 4, further comprising spreader plates individually attached to each of the proximal end and the distal end of the base beam.

7. The apparatus of claim 6, further comprising a retracted transport roller extending from the spreader plate at the proximal end of the base beam for operably transporting the apparatus.

8. The apparatus of claim 1, wherein the mechanical power inlet has a working end defining a surface that is engageable with a standard size tool bit in a close mating relationship to impart the input torque.

9. The apparatus of claim 1, wherein a gear turn ratio of the first gear to the second gear is at least about three to one.

10. A jack stand, comprising:

a frame having a longitudinal base beam defining a proximal end and an opposing distal end, and the frame having an upright support beam connected to the base beam between the proximal end and a base beam midpoint and extending substantially orthogonal from the base beam;

a lead screw supported by the frame for selective rotation in a first direction and a second direction; and a carrier threadingly engaging the lead screw, the carrier comprising a web member;

a first guide roller attached to the web member for rolling engagement against one side of the support rail;

a second guide roller attached to the web member for operable rolling engagement against an opposing side of the support rail;

a threaded follower attached to the web member and threadingly engaging the lead screw; and a support arm extending from the web and sized to operably and matingly engage the workpiece for lifting the workpiece;

wherein rotation of the lead screw in the first direction linearly advances the carrier in a lifting direction and rotation of the lead screw in the second direction linearly advances the carrier in a lowering direction.

11. The jack stand described in claim 10, comprising:

a mechanical power inlet adapted for receiving an input torque by a user; and a mechanical power transmission having a first gear fixed in rotation with the mechanical power inlet and a second gear fixed in rotation with the lead screw, the first and second gears sized so that the user torque imparted on the first gear is less than an output torque imparted by the second gear to the lead screw.

12. The apparatus described in claim 11, wherein a gear turn ratio of the first gear to the second gear is at least about three to one.

13. The apparatus described in claim 10, wherein the carrier further comprises a retainer member selectively moveable between an open position and a closed position, wherein the open position permits operable linear advancement of the carrier to contactingly engage the workpiece and the closed position operably retains the workpiece upon the carrier.

14. The apparatus of claim 10, wherein the threaded follower is pinned in its attachment to the web to permit displacement of the threaded follower in relation to the lead screw.

15. The apparatus of claim 14, wherein the threaded follower is pinned to articulate around an axis that is substantially perpendicular to the base beam.

16. The apparatus of claim 14, wherein the threaded follower is pinned to articulate around an axis that is substantially parallel to the base beam.

17. An apparatus for lifting a workpiece, the apparatus comprising:

a pair of jack stands, each jack stand comprising:

an upright frame;

a lead screw supported by the frame for selective rotation;

a carrier threadingly engaging the lead screw, the carrier comprising:

a web member;

a first guide roller attached to the web member for rolling engagement against one side of the support rail;

a second guide roller attached to the web member for operable rolling engagement against an opposing side of the support rail;

a threaded follower attached to the web member and threadingly engaging the lead screw; and a support arm extending from the web and sized to operably and matingly engage the workpiece for lifting the workpiece;

wherein rotation of the lead screw in one rotational direction linearly advances the carrier in a lifting direction and rotation of the lead screw in the opposite rotational direction linearly advances the carrier in a lowering direction;

a mechanical power inlet adapted for receiving an input torque from a user; and a mechanical power transmission having a first gear fixed in rotation with the mechanical power inlet and a different second gear fixed in rotation with the lead screw, the first and second gears sized so that the input torque imparted on the first gear is less than an output torque imparted by the second gear to the lead screw;

an axle with a first axle end and a second axle end;

wherein a workpiece throughwhich the axle is inserted is lifted by the jack stands engaging the first axle end and the second axle end upon the carriers, respectively, and advancing each lead screw in the direction to lift the carrier.

* * * * *